US011260496B2

(12) United States Patent
Yagi et al.

(10) Patent No.: US 11,260,496 B2
(45) Date of Patent: Mar. 1, 2022

(54) POLISHING METHOD AND POLISHING APPARATUS

(71) Applicant: EBARA CORPORATION, Tokyo (JP)

(72) Inventors: Keita Yagi, Tokyo (JP); Yuki Watanabe, Tokyo (JP); Toshimitsu Sasaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 798 days.

(21) Appl. No.: 16/166,946

(22) Filed: Oct. 22, 2018

(65) Prior Publication Data

US 2019/0118333 A1 Apr. 25, 2019

(30) Foreign Application Priority Data

Oct. 24, 2017 (JP) ..... 2017-205400

(51) Int. Cl.
*B24B 37/013* (2012.01)
*B24B 49/16* (2006.01)
(Continued)

(52) U.S. Cl.
CPC ..... *B24B 37/013* (2013.01); *B24B 37/042* (2013.01); *B24B 49/105* (2013.01); *B24B 49/16* (2013.01)

(58) Field of Classification Search
CPC ..... B24B 37/013; B24B 37/005; B24B 37/04; B24B 37/10; B24B 37/105; B24B 37/042;
(Continued)

(56) References Cited

U.S. PATENT DOCUMENTS 6,004,187 A 12/1999 Nyui et al.
2005/0095958 A1 5/2005 Yun et al.
(Continued)

FOREIGN PATENT DOCUMENTS

CN 101302404 A 11/2008
CN 101511539 A 8/2009
(Continued)

OTHER PUBLICATIONS

Singapore Patent Application No. 10201809265V; Search Report Examination Report; dated Dec. 21, 2020; 7 pages.

*Primary Examiner* — Joel D Crandall
(74) *Attorney, Agent, or Firm* — BakerHostetler

(57) ABSTRACT

A polishing method which can acquire an actual position of a film-thickness measurement point, and can therefore apply an optimum polishing pressure to a substrate such as a wafer is disclosed. The method includes: causing a substrate detection sensor to generate substrate detection signals in a preset cycle and causing a film-thickness sensor to generate a film-thickness signal at a predetermined measurement point during polishing of the substrate while the substrate detection sensor and the film-thickness sensor are moving across the surface of the substrate; calculating an angle of eccentricity of a center of the substrate relative to a center of the polishing head from the number of substrate detection signals; correcting a position of the predetermined measurement point based on the angle of eccentricity; and controlling polishing pressure at which the polishing head presses the substrate based on the film-thickness signal and the corrected position of the predetermined measurement point.

13 Claims, 12 Drawing Sheets

(51) Int. Cl.
*B24B 49/10* (2006.01)
*B24B 37/04* (2012.01)

(58) Field of Classification Search
CPC ..... B24B 37/046; B24B 49/10; B24B 49/105; B24B 49/12; B24B 49/04; B24B 49/045; B24B 49/02; B24B 49/16
See application file for complete search history.

(56) References Cited

U.S. PATENT DOCUMENTS

| | | | | |
|---|---|---|---|---|
| 2009/0130956 | A1 | 5/2009 | Ohta et al. | |
| 2012/0164917 | A1 | 6/2012 | Kobata et al. | |
| 2013/0273812 | A1 | 10/2013 | Qian et al. | |
| 2015/0104999 | A1 * | 4/2015 | Seki | B24B 37/30 451/28 |
| 2015/0147940 | A1 | 5/2015 | Benvegnu et al. | |

FOREIGN PATENT DOCUMENTS

| | | | | |
|---|---|---|---|---|
| CN | 102179771 | A | 9/2011 | |
| CN | 102601719 | A | 7/2012 | |
| CN | 104275642 | A | 1/2015 | |
| CN | 105428229 | A | 3/2016 | |
| EP | 0687526 | A1 * | 12/1995 | B24B 37/005 |
| JP | 2009-094382 | A | 4/2009 | |
| JP | 2012-138442 | A | 7/2012 | |
| TW | 431948 | B | 5/2001 | |
| TW | 200927378 | A | 7/2009 | |
| WO | WO-2014103657 | A1 * | 7/2014 | C30B 25/16 |

* cited by examiner

POLISHING METHOD AND POLISHING APPARATUS

CROSS REFERENCE TO RELATED APPLICATION

This document claims priority to Japanese Patent Application Number 2017-205400 filed Oct. 24, 2017, the entire contents of which are hereby incorporated by reference.

BACKGROUND

These days, semiconductor devices have become increasingly finer and their interconnect widths have now reached a level of less than 10 nm, which requires strict nanometer-level control of a thickness of a film of a wafer. A polishing apparatus for polishing a wafer surface are configured to obtain a film thickness distribution on the entire wafer surface, including a central area and an edge area, during polishing of the wafer and control polishing pressure applied to the wafer based on the film thickness distribution obtained.

FIG. 16 is a schematic view of a conventional polishing apparatus. While a polishing table 101 and a polishing head 102 are rotating in the same direction, slurry is supplied from a slurry nozzle 105 onto a polishing pad 110 on the polishing table 101. The polishing head 102 presses a wafer W against the polishing pad 110 to polish the surface of the wafer W in the presence of the slurry between the wafer W and the polishing pad 110. The polishing head 102 includes a retainer ring 103 disposed around the wafer W. The retainer ring 103 prevents the wafer W from moving outside the polishing head 102 during polishing of the wafer W.

A film-thickness sensor 112, which is disposed in the polishing table 101, measures a film thickness of the wafer W while the film-thickness sensor 112 sweeps across the surface of the wafer W each time the polishing table 101 makes one rotation. A measured value of the film thickness is fed back to a controller 117. The controller 117 determines an optimum polishing pressure based on the measured value of the film thickness, and the polishing head 102 presses the wafer W against the polishing pad 110 by applying the determined polishing pressure to the wafer W. Such feedback control can achieve a target film-thickness profile.

The above-described film-thickness sensor 112 is located at such a position as to pass over the center of the polishing head 102 each time the polishing table 101 makes one rotation. Therefore, measurement points of the film thickness are distributed over an area of the wafer W, including the center and the edge area. On the assumption that the measurement points of the film thickness are distributed over the area, including the center and the edge area, of the wafer W, the controller 117 determines a polishing pressure which is appropriate for each individual measurement point, based on a measured value of the film thickness at that measurement point and on location information of that measurement point.

However, as shown in FIG. 17, there is a difference between an inner diameter of the retainer ring 103 and a diameter of the wafer W. During polishing of the wafer W, due to a frictional force that acts between the wafer W and the polishing pad 110, the perimeter of the wafer W is pressed against an inner peripheral surface 103*a* of the retainer ring 103. As a result, the center of the wafer W deviates from the center of the polishing head 102; therefore, the actual measurement points of the film thickness differ from the above-described hypothetical measurement points.

Unless location information of a measurement point is accurate, it is not possible to apply to the wafer W an optimum polishing pressure for that measurement point. Especially in the edge area of the wafer W, a thickness of a film changes greatly according to a radial position, and therefore the optimum polishing pressure necessarily changes according to the radial position. Accordingly, the positional difference between an actual measurement point and the above-described hypothetical measurement point causes a difference between the polishing pressure determined by the controller 117 and the optimum polishing pressure. This may result in a failure to obtain a target film-thickness profile.

SUMMARY OF THE INVENTION

According to embodiments, there are provided a polishing method and a polishing apparatus which can acquire an actual position of a film-thickness measurement point, and can therefore apply an optimum polishing pressure to a substrate such as a wafer.

Embodiments, which will be described below, relate to a method and apparatus for polishing a substrate such as a wafer, and more particularly to a method and apparatus for obtaining a film thickness distribution on a substrate surface, including a central area and an edge area, during polishing of the substrate and controlling polishing pressure applied to the substrate based on the film thickness distribution obtained.

In an embodiment, there is provided a polishing method comprising: rotating a polishing table in which a substrate detection sensor and a film-thickness sensor are disposed; pressing a substrate against a polishing pad on the polishing table by a polishing head, including a retainer ring, to polish the substrate; causing the substrate detection sensor to generate substrate detection signals in a preset cycle and causing the film-thickness sensor to generate a film-thickness signal at a predetermined measurement point during polishing of the substrate while the substrate detection sensor and the film-thickness sensor are moving across a surface of the substrate; calculating an angle of eccentricity of a center of the substrate relative to a center of the polishing head from the number of substrate detection signals; correcting a position of the predetermined measurement point based on the angle of eccentricity; and controlling polishing pressure at which the polishing head presses the substrate based on the film-thickness signal and the corrected position of the predetermined measurement point.

In an embodiment, a distance from a center of the polishing table to the substrate detection sensor is shorter than a distance from the center of the polishing table to the film-thickness sensor.

In an embodiment, during polishing of the substrate, the substrate detection sensor moves across an edge area of the substrate, and the film-thickness sensor moves across the edge area and an area inside the edge area.

In an embodiment, correcting the position of the predetermined measurement point based on the angle of eccentricity comprises: calculating a coordinate correction value from the angle of eccentricity and a numerical value obtained by dividing a difference between a diameter of the substrate and an inner diameter of the retainer ring by 2; and correcting the position of the predetermined measurement point based on the coordinate correction value.

In an embodiment, the substrate detection sensor is a film-thickness sensor.

In an embodiment, the substrate detection sensor is an optical film-thickness sensor.

In an embodiment, the substrate detection sensor is an eddy-current sensor.

In an embodiment, there is provided a polishing apparatus comprising: a polishing table for supporting a polishing pad; a polishing head configured to press a substrate against the polishing pad to polish the substrate; a film-thickness sensor configured to generate a film-thickness signal at a predetermined measurement point, the film-thickness sensor being installed in the polishing table; a substrate detection sensor configured to generate substrate detection signals in a preset cycle, the substrate detection sensor being installed in the polishing table; a data processor configured to calculate an angle of eccentricity of a center of the substrate relative to a center of the polishing head from the number of substrate detection signals, correct a position of the predetermined measurement point based on the angle of eccentricity, and determine a target value of polishing pressure at which the polishing head presses the substrate based on the film-thickness signal and the corrected position of the predetermined measurement point; and an operation controller configured to control the polishing pressure at which the polishing head presses the substrate based on the target value of polishing pressure.

In an embodiment, a distance from a center of the polishing table to the substrate detection sensor is shorter than a distance from the center of the polishing table to the film-thickness sensor.

In an embodiment, the data processor is configured to: calculate a coordinate correction value from the angle of eccentricity and a numerical value obtained by dividing a difference between a diameter of the substrate and an inner diameter of the retainer ring by 2; and correct the position of the predetermined measurement point based on the coordinate correction value.

In an embodiment, the substrate detection sensor is a film-thickness sensor.

In an embodiment, the substrate detection sensor is an optical film-thickness sensor.

In an embodiment, the substrate detection sensor is an eddy-current sensor.

According to the above-described embodiments, an actual position of a measurement point of the film thickness can be determined from the angle of eccentricity of the substrate. Therefore, the optimum polishing pressure can be determined based on a film-thickness signal generated at the actual position of the measurement point. This makes it possible to achieve a target film-thickness profile.

DESCRIPTION OF EMBODIMENTS

Embodiments will now be described with reference to the drawings.

Figure 1:
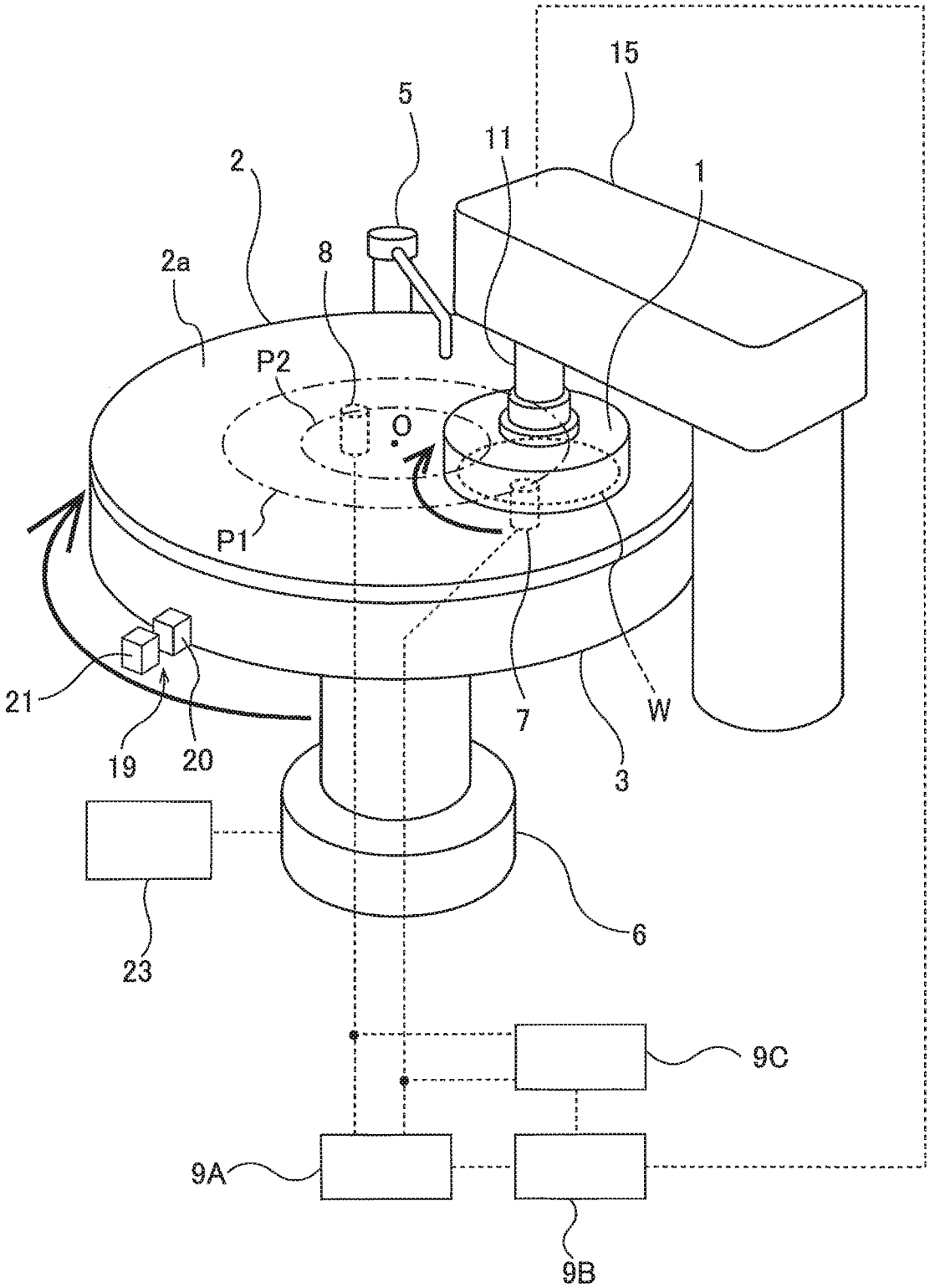
FIG. 1 is a schematic view showing an embodiment of a polishing apparatus.

FIG. 1 is a schematic view showing an embodiment of a polishing apparatus. As shown in FIG. 1, the polishing apparatus includes a polishing table 3 that supports a polishing pad 2, a polishing head 1 for pressing a wafer W, which is an example of a substrate, against the polishing pad 2, a table motor 6 for rotating the polishing table 3, and a polishing-liquid supply nozzle 5 for supplying a polishing liquid (slurry) onto the polishing pad 2. The surface of the polishing pad 2 constitutes a polishing surface 2*a* for polishing the wafer W. The polishing table 3 is coupled to the table motor 6, which rotates the polishing table 3 and the polishing pad 2 together. The polishing head 1 is secured to an end of a polishing head shaft 11, which is rotatably supported by a head arm 15.

The wafer W is polished in the following manner. While the polishing table 3 and the polishing head 1 are rotating in directions indicated by arrows in FIG. 1, the polishing liquid is supplied from the polishing-liquid supply nozzle 5 onto the polishing surface 2*a* of the polishing pad 2 on the polishing table 3. While the wafer W is being rotated by the polishing head 1, the wafer W is pressed against the polishing surface 2*a* of the polishing pad 2 in the presence of the polishing liquid between the polishing pad 2 and the wafer W. The surface of the wafer W is polishing by the chemical action of the polishing liquid and by the mechanical action of abrasive particles contained in the polishing liquid.

A film-thickness sensor 7 and a wafer detection sensor (substrate detection sensor) 8 are disposed in the polishing table 3. The film-thickness sensor 7 and the wafer detection sensor 8 rotate together with the polishing table 3 and the polishing pad 2. The film-thickness sensor 7 and the wafer detection sensor 8 are each located in such a position as to traverse a surface (i.e., a lower surface to be polished) of the wafer W on the polishing pad 2 each time the polishing table 3 and the polishing pad 2 make one rotation. The wafer detection sensor 8 is located across the center O of the polishing table 3 from the film-thickness sensor 7. In this embodiment, the film-thickness sensor 7, the center O of the polishing table 3, and the wafer detection sensor 8 align in a straight line.

The film-thickness sensor 7 is a sensor that generates a film-thickness signal which indicates the film thickness at a predetermined measurement point on the surface of the wafer W. The wafer detection sensor 8 is a sensor that detects the wafer W and generates a wafer detection signal (substrate detection signal) indicating that the wafer W is present over the wafer detection sensor 8. The film-thickness sensor 7 and the wafer detection sensor 8 generate the film-thickness signal and the wafer detection signal, respectively, while the film-thickness sensor 7 and the wafer detection sensor 8 sweep across the surface of the wafer W.

The film-thickness sensor 7 and the wafer detection sensor 8 are coupled to a data processor 9A. The film-thickness signal outputted by the film-thickness sensor 7 and the wafer detection signal outputted by the wafer detection sensor 8 are sent to the data processor 9A. A dedicated computer or a general-purpose computer, having a processing unit and a memory, can be used as the data processor 9A.

Figure 2:
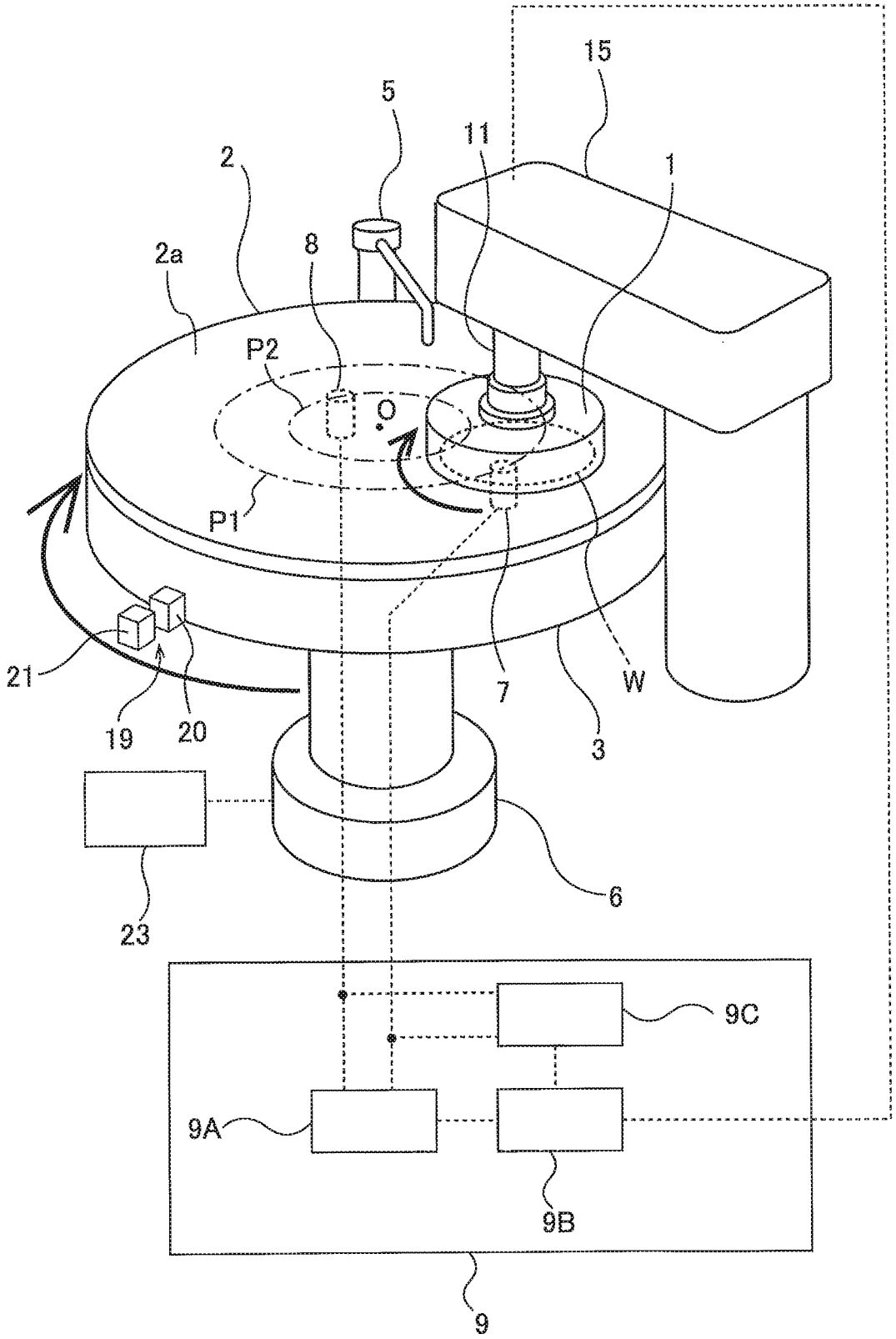
FIG. 2 is a schematic view showing an embodiment in which a data processor, an operation controller, and a sensor controller shown in FIG. 1 are constituted by one computer.

The polishing apparatus also includes an operation controller 9B for controlling operations of the polishing head 1, the polishing table 3 and the polishing-liquid supply nozzle 5. Furthermore, the polishing apparatus includes a sensor controller 9C for controlling operations of the film-thickness sensor 7 and the wafer detection sensor 8. The film-thickness sensor 7 and the wafer detection sensor 8 are coupled to the sensor controller 9C. The operation controller 9B is coupled to the data processor 9A, and the sensor controller 9C is coupled to the operation controller 9B. The data processor 9A, the operation controller 9B, and the sensor controller 9C may each be comprised of a dedicated computer or a general-purpose computer. Alternatively, as in an embodiment shown in FIG. 2, a single dedicated or general-purpose computer 9 may include the data processor 9A, the operation controller 9B, and the sensor controller 9C.

The operation controller 9B transmits a measurement starting signal and measurement condition information to the sensor controller 9C. Upon receipt of the measurement starting signal, the sensor controller 9C sends trigger signals to the film-thickness sensor 7 and the wafer detection sensor 8, respectively, each time the polishing table 3 makes one rotation. The film-thickness sensor 7 generates the above-described film-thickness signal upon receipt of the trigger signal. The wafer detection sensor 8 generates the above-described wafer detection signal upon receipt of the trigger signal and when the wafer W is present over the wafer detection sensor 8. A transmission cycle of trigger signals to the film-thickness sensor 7 and a transmission cycle of trigger signals to the wafer detection sensor 8 correspond to preset cycles contained in the measurement condition information. Thus, the sensor controller 9C generates trigger signals in the respective preset cycles contained in the measurement condition information, and sends the trigger signals successively to the film-thickness sensor 7 and the wafer detection sensor 8.

The sensor controller 9C determines timings for transmitting the trigger signals to the film-thickness sensor 7 and the wafer detection sensor 8 based on a rotational speed of the polishing table 3 and a signal indicating a rotational position of the polishing table 3 sent from a table rotational position detector 19. The sensor controller 9C transmits the trigger signals to the film-thickness sensor 7 and the wafer detection sensor 8 with the determined timings. More specifically, the sensor controller 9C transmits trigger signals to the film-thickness sensor 7 and to the wafer detection sensor 8 with different timings. Therefore, each time the polishing table 3 makes one rotation, the film-thickness sensor 7 and the wafer detection sensor 8 generate film-thickness signals and wafer detection signals, respectively, with different timings while the film-thickness sensor 7 and the wafer detection sensor 8 are sweeping across the surface of the wafer W.

The table rotational position detector 19 is comprised of a combination of a sensor target 20 secured to the polishing table 3, and a proximity sensor 21 disposed beside the polishing table 3. The sensor target 20 rotates together with the polishing table 3, whereas the position of the proximity sensor 21 is fixed. Upon sensing the sensor target 20, the proximity sensor 21 transmits a signal indicating the rotational position of the polishing table 3 to the sensor controller 9C. The sensor controller 9C can calculate a current rotational position of the polishing table 3 based on the rotational speed of the polishing table 3 and the signal indicating the rotational position of the polishing table 3. In one embodiment, the table rotational position detector 19 may be comprised of a motor driver 23 for the table motor 6.

In this embodiment, the wafer detection sensor 8 is located nearer to the center O of the polishing table 3 than the film-thickness sensor 7. More specifically, a distance from the center O of the polishing table 3 to the wafer detection sensor 8 is shorter than a distance from the center O of the polishing table 3 to the film-thickness sensor 7. Therefore, along with the rotation of the polishing table 3, the film-thickness sensor 7 traverses the surface of the wafer W in a path P1, while the wafer detection sensor 8 traverses the surface of the wafer W in a path P2 which differs from the path P1.

Figure 3:
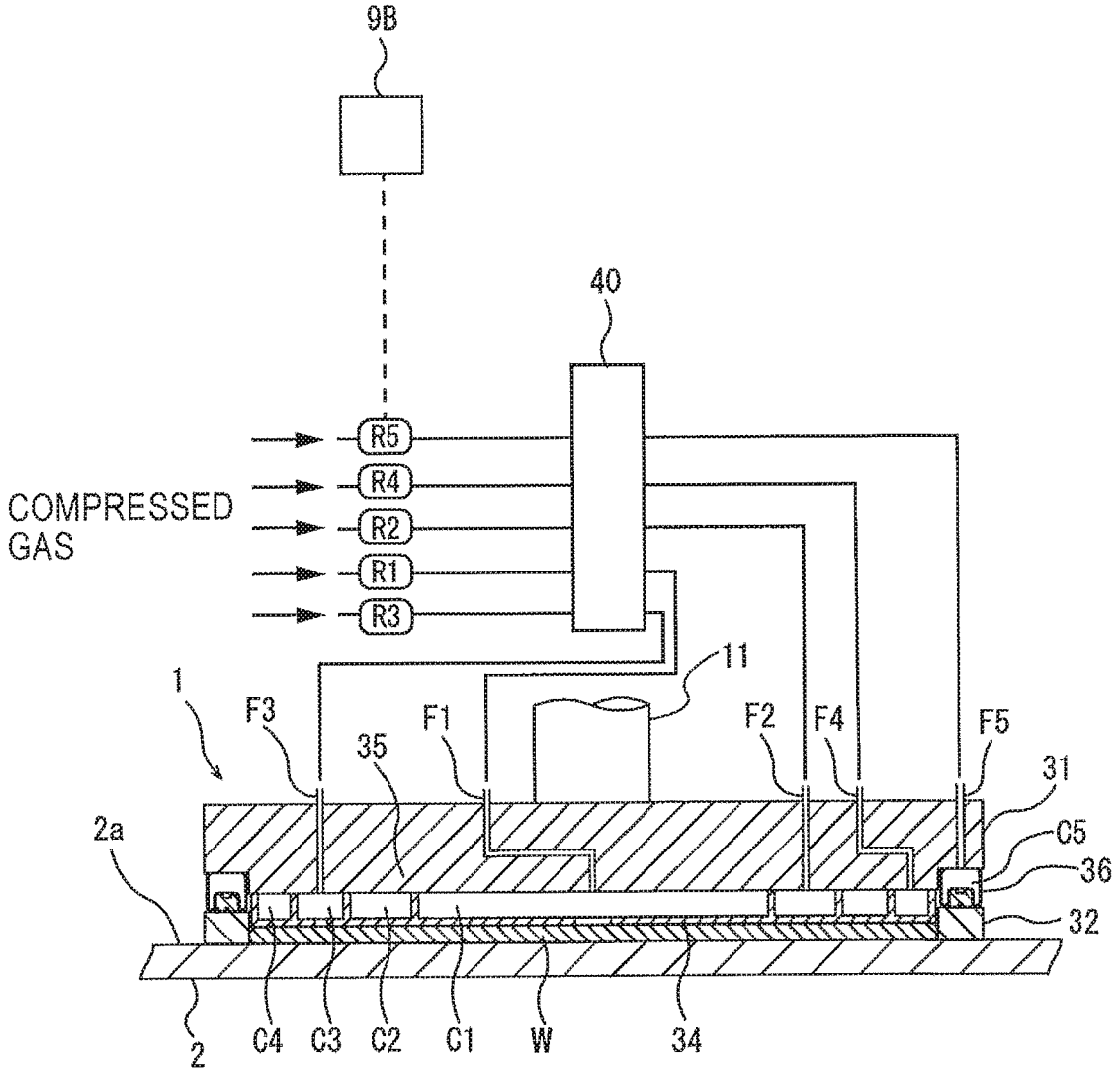
FIG. 3 is a cross-sectional view of a polishing head.

Next, the polishing head 1 will be described below FIG. 3 is a cross-sectional view showing the polishing head 1. The polishing head 1 includes a head body 31 fixed to the end of the polishing head shaft 11, a membrane (or an elastic membrane) 34 attached to a lower part of the head body 31, and a retainer ring 32 disposed below the head body 31. The retainer ring 32 is arranged around the membrane 34. The retainer ring 32 is an annular structure for retaining the wafer W so as to prevent the wafer W from being ejected from the polishing head 1 during polishing of the wafer W.

Four pressure chambers C1, C2, C3, and C4 are provided between the membrane 34 and the head body 31. The pressure chambers C1, C2, C3, and C4 are formed by the membrane 34 and the head body 31. The central pressure chamber C1 has a circular shape, and the other pressure chambers C2, C3, and C4 have an annular shape. These pressure chambers C1, C2, C3, and C4 are in a concentric arrangement.

Gas delivery lines F1, F2, F3, and F4 are coupled to the pressure chambers C1, C2, C3, and C4, respectively. One end of each of the gas delivery lines F1, F2, F3, and F4 is coupled to a compressed-gas supply source (not shown), which is provided as one of utilities in a factory in which the polishing apparatus is installed. A compressed gas, such as compressed air, is supplied into the pressure chambers C1, C2, C3, and C4 through the gas delivery lines F1, F2, F3, and F4, respectively.

The gas delivery line F3, which communicates with the pressure chamber C3, is coupled to a vacuum line (not shown), so that a vacuum can be formed in the pressure chamber C3. The membrane 34 has an opening in a portion that forms the pressure chamber C3, so that the wafer W can be held by the polishing head 1 via vacuum suction by producing a vacuum in the pressure chamber C3. Further, the wafer W can be released from the polishing head 1 by supplying the compressed gas into the pressure chamber C3.

An annular membrane (or an annular rolling diaphragm) 36 is provided between the head body 31 and the retainer ring 32, and a pressure chamber C5 is formed in this membrane 36. The pressure chamber C5 communicates with the compressed-gas supply source through a gas delivery line F5. The compressed-gas supply source supplies the compressed gas into the pressure chamber C5 through the gas delivery line F5, so that the pressure chamber C5 presses the retainer ring 32 against the polishing pad 23.

The gas delivery lines F1, F2, F3, F4, and F5 extend via a rotary joint 40 attached to the polishing head shaft 11. The gas delivery lines F1, F2, F3, F4, and F5, communicating with the pressure chambers C1, C2, C3, C4, and C5, respectively, are provided with pressure regulators R1, R2, R3, R4, and R5, respectively. The compressed gas from the compressed-gas supply source is supplied through the pressure regulators R1 to R5 into the pressure chambers C1 to C5, respectively and independently. The pressure regulators R1 to R5 are configured to regulate the pressures of the compressed gases in the pressure chambers C1 to C5.

The pressure regulators R1 to R5 can change independently the pressures in the pressure chambers C1 to C5 to thereby independently adjust the polishing pressures against corresponding four areas of the wafer W, i.e., a central area; an inner intermediate area; an outer intermediate area; and an edge area, and a pressing force of the retainer ring 32 against the polishing pad 2. The gas delivery lines F1, F2, F3, F4 and F5 are coupled to vent valves (not shown), respectively, so that the pressure chambers C1 to C5 can be vented to the atmosphere. The membrane 34 in this embodiment defines the four pressure chambers C1 to C4, while, in one embodiment, the membrane 34 may define less than four pressure chambers or more than four pressure chambers.

The data processor 9A (see FIGS. 1 and 2) receives the film-thickness signals, each indicating a film thickness of the wafer W, from the film-thickness sensor 7 and, based on the film-thickness signals, determines target pressure values of the pressure chambers C1 to C4 for achieving a target film-thickness profile, and transmits the target pressure values to the operation controller 9B. The target pressure values of the pressure chambers C1 to C4 correspond to target values of polishing pressures to be applied from the polishing head 1 to the wafer W. The pressure regulators R1 to R5 are coupled to the operation controller 9B. The operation controller 9B sends, as command values, the respective target pressure values of the pressure chambers C1 to C5 to the pressure regulators R1 to R5, which in turn operate to maintain the pressures in the pressure chambers C1 to C5 at the corresponding target pressure values.

The polishing head 1 can apply independent polishing pressures to the plurality of areas of the wafer W. For example, the polishing head 1 can press the different areas of the surface of the wafer W at different polishing pressures against the polishing surface 2*a* of the polishing pad 2. Therefore, the polishing head 1 can control the film-thickness profile of the wafer W so as to achieve a target film-thickness profile.

The film-thickness sensor 7 is a sensor configured to output a film-thickness signal which varies according to a film thickness of the wafer W. The film-thickness signal is a numerical value or data (numerical group) which directly or indirectly indicates a film thickness. The film-thickness sensor 7 is, for example, comprised of an optical film-thickness sensor or an eddy-current sensor. The optical film-thickness sensor is configured to irradiate the surface of the wafer W with light, measure intensities of reflected light from the wafer W at respective wavelengths, and output the intensities of the reflected light in relation to the wavelengths. The intensities of the reflected light in relation to the wavelengths are a film-thickness signal which varies according to the film thickness of the wafer W. The eddy-current sensor induces eddy currents in a conductive film formed on the wafer W, and outputs a film-thickness signal which varies according to an impedance of an electrical circuit including the conductive film and a coil of the eddy-current sensor. The optical film-thickness sensor and the eddy-current sensor that can be used in this embodiment may be known devices.

Figure 4:
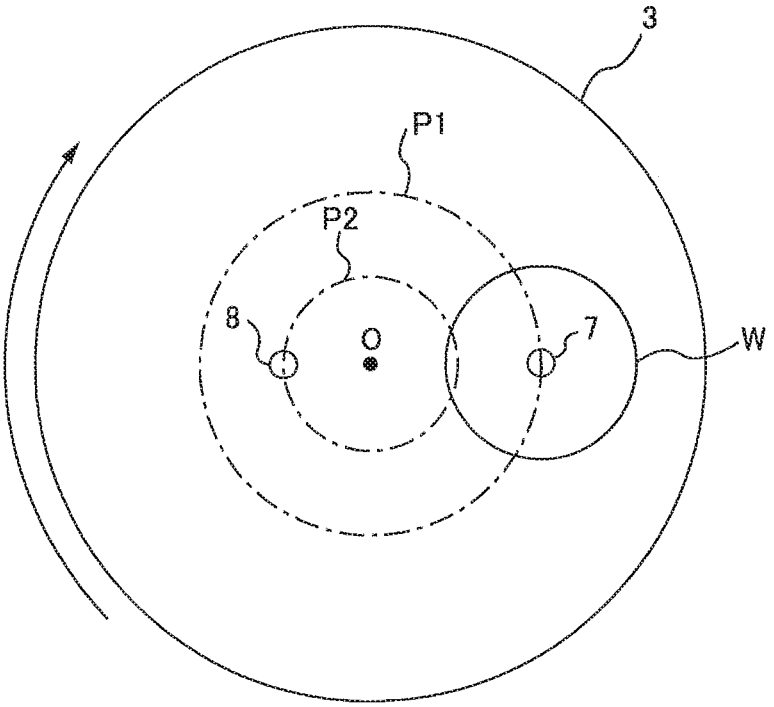
FIG. 4 is a plan view showing an arrangement of a film-thickness sensor and a wafer detection sensor (a substrate detection sensor) installed in a polishing table.

FIG. 4 is a plan view showing an arrangement of the film-thickness sensor 7 and the wafer detection sensor (substrate detection sensor) 8 installed in the polishing table 3. The depiction of the polishing pad 2 has been omitted from FIG. 4. As described above, the distance from the center O of the polishing table 3 to the wafer detection sensor 8 is shorter than the distance from the center O of the polishing table 3 to the film-thickness sensor 7. Therefore, along with the rotation of the polishing table 3, the film-thickness sensor 7 traverses the surface of the wafer W in the path P1, while the wafer detection sensor 8 traverses the surface of the wafer W in the path P2 which differs from the path P1.

In this embodiment, an angle between a line extending from the center O of the polishing table 3 to the film-thickness sensor 7 and a line extending from the center O of the polishing table 3 to the wafer detection sensor 8 is 180 degrees. Thus, the film-thickness sensor 7, the center O of the polishing table 3, and the wafer detection sensor 8 align in a straight line. In one embodiment, an angle between a line extending from the center O of the polishing table 3 to the film-thickness sensor 7 and a line extending from the center O of the polishing table 3 to the wafer detection sensor 8 may be an angle other than 180 degrees.

Figure 5:
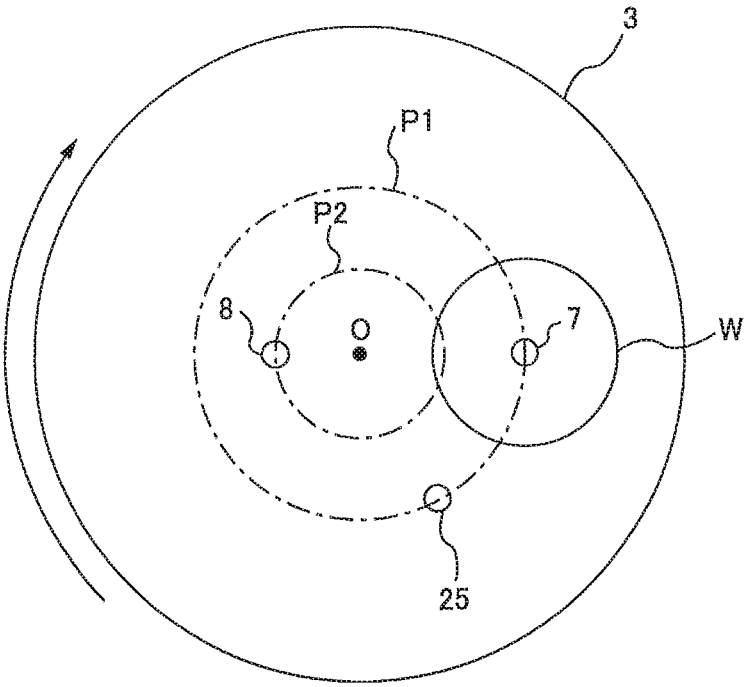
FIG. 5 is a sensor arrangement diagram of a polishing apparatus including a film-thickness sensor comprising an optical film-thickness sensor and a film-thickness sensor comprising an eddy current sensor.

The film-thickness sensor 7 is an optical film-thickness sensor or an eddy-current sensor. A plurality of film-thickness sensors may be provided in the polishing table 3. FIG. 5 is a sensor layout plan of a polishing apparatus including the film-thickness sensor 7 comprised of an optical film-thickness sensor, and a film-thickness sensor 25 comprised of an eddy-current sensor. The film-thickness sensor 7 and the film-thickness sensor 25 are at the same distance from the center O of the polishing table 3, and are away from each other in the circumferential direction of the polishing table 3. The positions of the film-thickness sensor 7 and the wafer detection sensor 8, shown in FIG. 5, are the same as those of the embodiment illustrated in FIG. 4. The film-thickness sensor 7 and the film-thickness sensor 25 move across the surface of the wafer W in the same path P1.

The film-thickness sensor 7 and the film-thickness sensor 25 may be simultaneously used during polishing of the wafer W. Alternatively, one of the film-thickness sensor 7 and the film-thickness sensor 25 may be selectively used based on the type of film of the wafer W. In addition to the film-thickness sensor 7 and the film-thickness sensor 25, one or more film-thickness sensors may be further provided.

Figure 6:
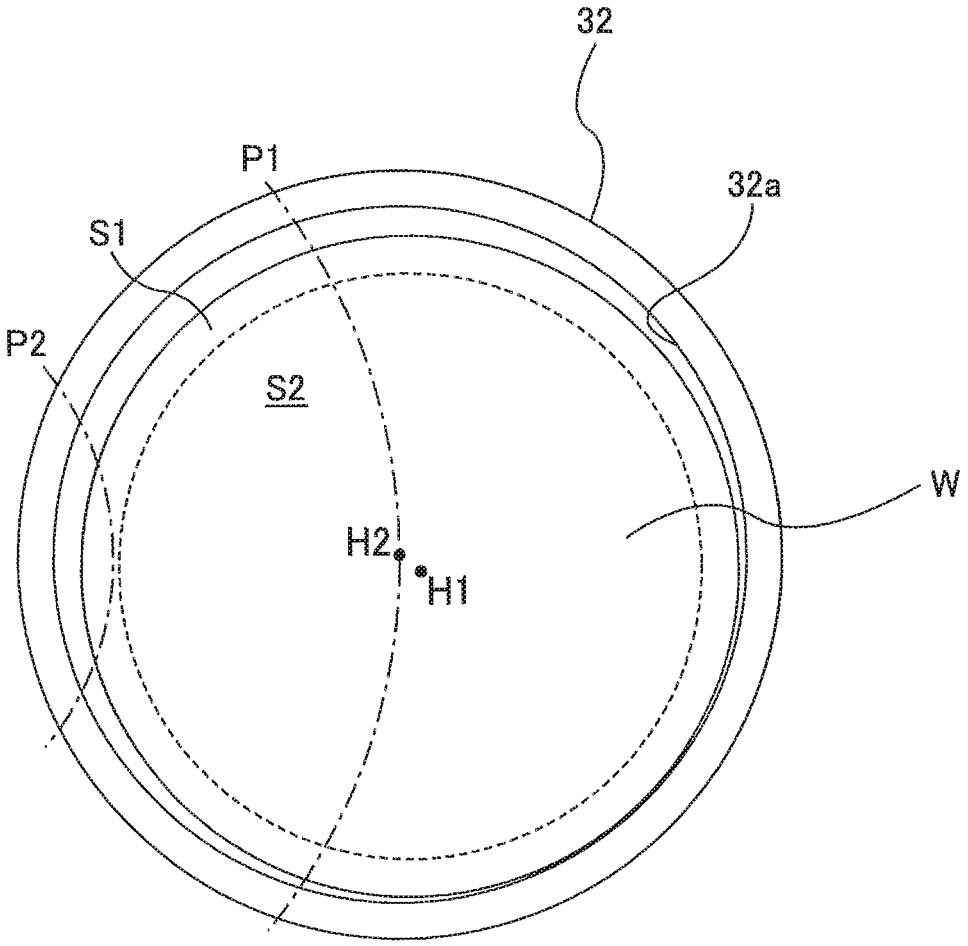
FIG. 6 is a schematic view showing a wafer and a retainer ring during polishing of the wafer.

FIG. 6 is a schematic view showing the wafer W and the retainer ring 32 during polishing. Along with the rotation of the polishing table 3, the film-thickness sensor 7 moves in the path P1 across an edge area S1 of the wafer W and an area S2 inside the edge area S1, while the wafer detection sensor 8 moves in the path P2 across only the edge area S1 of the wafer W. The edge area S1 is an annular outermost area of the surface of the wafer W. The area S2 inside the edge area S1 is a circular area including a center H1 of the wafer W. The wafer detection sensor 8 generates wafer detection signals (substrate detection signals) in the preset cycle while moving across the edge area S1 of the wafer W. The wafer detection signals are signals which each indicate that the wafer W exists over the wafer detection sensor 8.

As shown in FIG. 6, the wafer W is surrounded by the retainer ring 32 during polishing of the wafer W. There is a difference between the inner diameter of the retainer ring 32 and the diameter of the wafer W. During polishing of the wafer W, due to a frictional force that acts between the wafer W and the polishing pad 2, the perimeter of the wafer W is pressed against an inner peripheral surface 32*a* of the retainer ring 32. As a result, the center H1 of the wafer W deviates from the center H2 of the polishing head 1.

While the path P2 of the wafer detection sensor 8 is constant regardless of the position of the wafer W within the retainer ring 32, the number of wafer detection signals can change depending on the position of the wafer W relative to the retainer ring 32. In this embodiment, the data processor 9A determines an angle of eccentricity of the center H1 of the wafer W relative to the center H2 of the polishing head 1 based on the number of wafer detection signals (substrate detection signals) per rotation of the polishing table 3. The principle of the determination of the angle of eccentricity will now be described.

Figure 7:
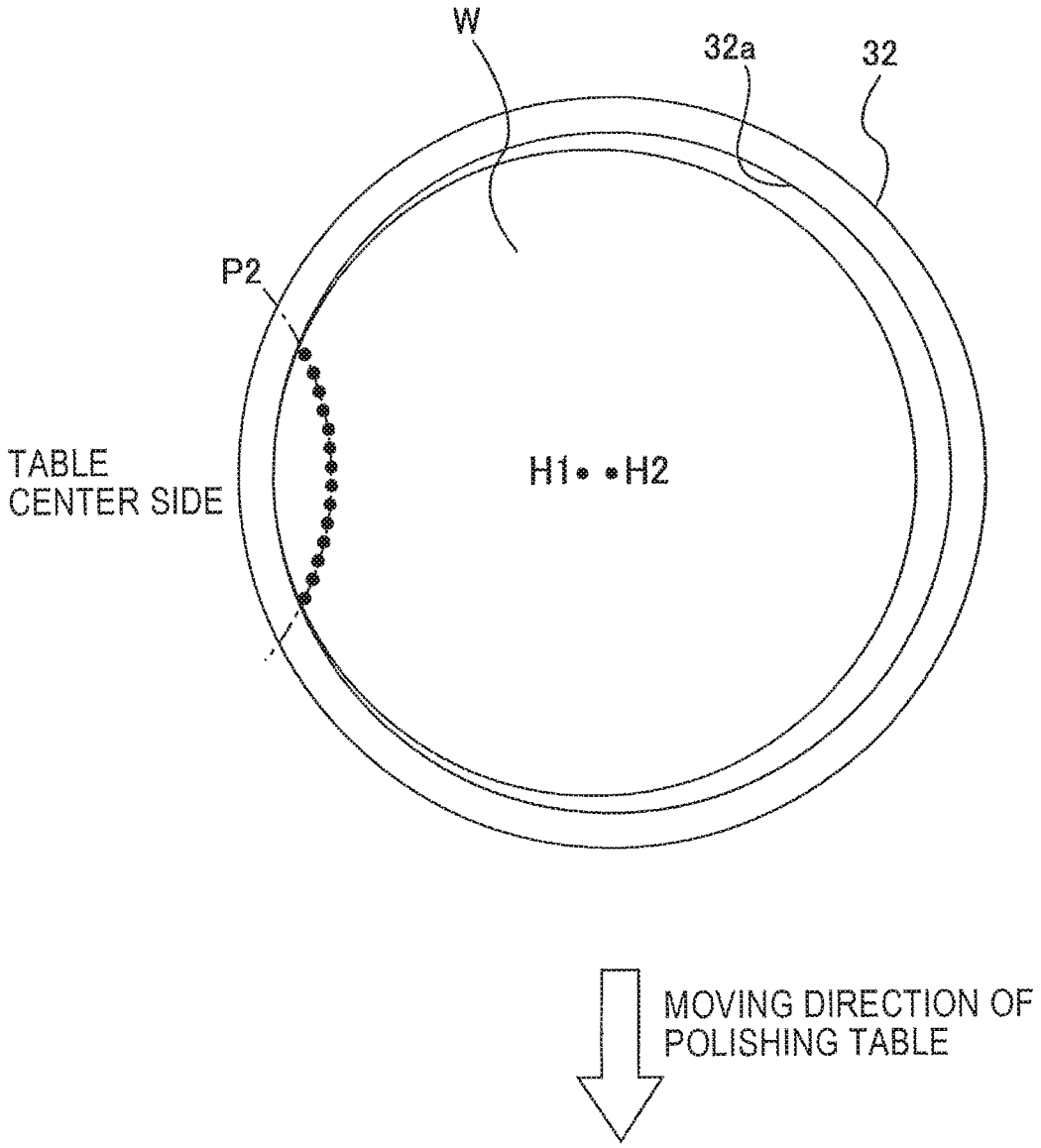
FIG. 7 is a schematic view showing an example in which the wafer in the retainer ring is biased toward the center of the polishing table.
Figure 8:
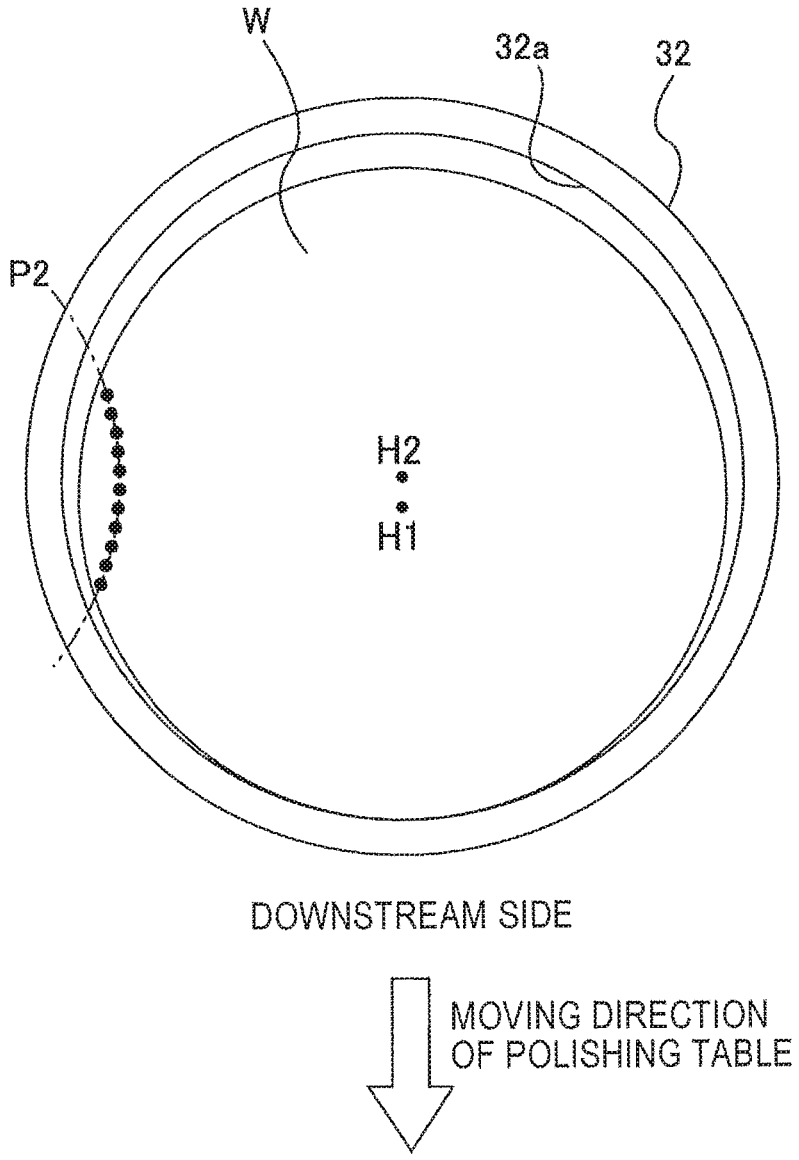
FIG. 8 is a schematic view showing an example in which the wafer in the retainer ring is biased toward a downstream side in a moving direction of the polishing table.

FIG. 7 is a schematic view illustrating an example in which the wafer W inside the retainer ring 32 is biased toward the center of the polishing table. The wafer detection sensor 8 generates wafer detection signals in the preset cycle. Black circles on the path P2 of the wafer detection sensor 8 denote detection points on the wafer W at which the wafer detection signals have been generated. The number of detection points (i.e. the number of black circles on the path P2) corresponds to the number of wafer detection signals. FIG. 8 is a schematic view illustrating an example in which the wafer W inside the retainer ring 32 is biased downstream in the moving direction of the polishing table 3, and FIG. 9 is a schematic view illustrating an example in which the wafer W inside the retainer ring 32 is biased toward the periphery of the polishing table 3.

Figure 9:
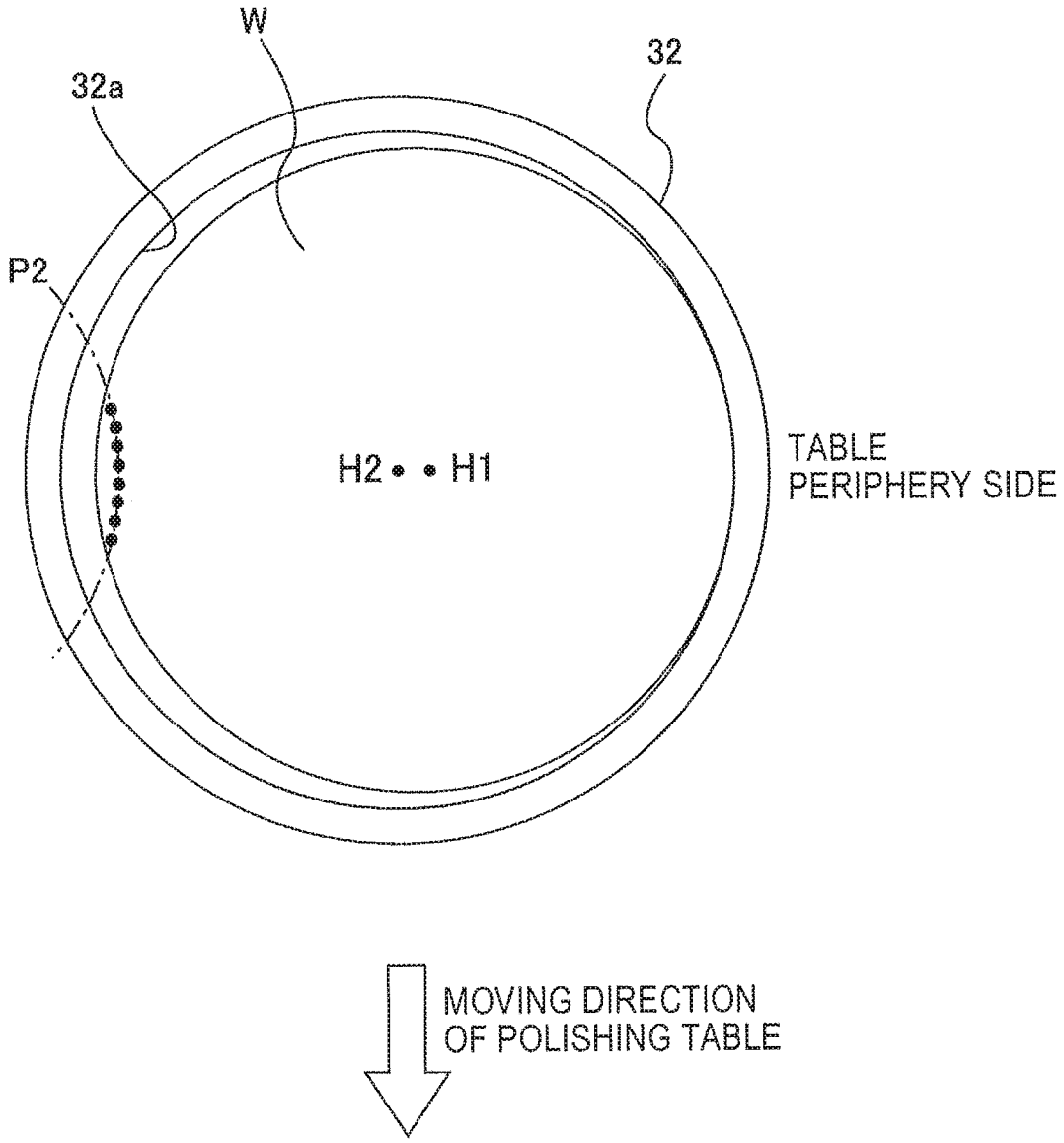
FIG. 9 is a schematic view showing an example in which the wafer in the retainer ring is biased toward the periphery of the polishing table.

As can be seen in FIGS. 7 through 9, the number of wafer detection signals (substrate detection signals) per rotation of the polishing table 3 changes depending on the position of the wafer W relative to the retainer ring 32. The perimeter of the wafer W keeps in contact with the inner peripheral surface 32*a* of the retainer ring 32 during polishing of the wafer W. Therefore, a distance between the center H1 of the wafer W and the center H2 of the polishing head 1 is constant regardless of the relative position of the wafer W. On the other hand, the angle of the eccentricity of the center H1 of the wafer W relative to the center H2 of the polishing head 1 changes depending on the position of the wafer W relative to the retainer ring 32. Thus, there is a correlation between the angle of the eccentricity and the number of wafer detection signals.

The data processor 9A stores in advance correlation data indicating a correlation between the angle of the eccentricity and the number of wafer detection signals. The data processor 9A counts the number of wafer detection signals per rotation of the polishing table 3 during polishing of the wafer W, and determines an angle of eccentricity, corresponding to the countered number of wafer detection signals, based on the correlation data.

The correlation data indicating the correlation between the angle of eccentricity and the number of wafer detection signals can be determined by a simulation. The following are parameters necessary to perform the simulation, i.e. parameters necessary to determine the correlation data indicating the correlation between the angle of eccentricity and the number of wafer detection signals:

Diameter of the wafer W

Inner diameter of the retainer ring 32

Distance between the center O of the polishing table 3 and the center H2 of the polishing head 1

Distance between the center O of the polishing table 3 and the wafer detection sensor 8

Rotational speed of the polishing table 3

Detection cycle of the wafer detection sensor 8

Angle of eccentricity of the center H1 of the wafer W relative to the center H2 of the polishing head 1

Figure 10:
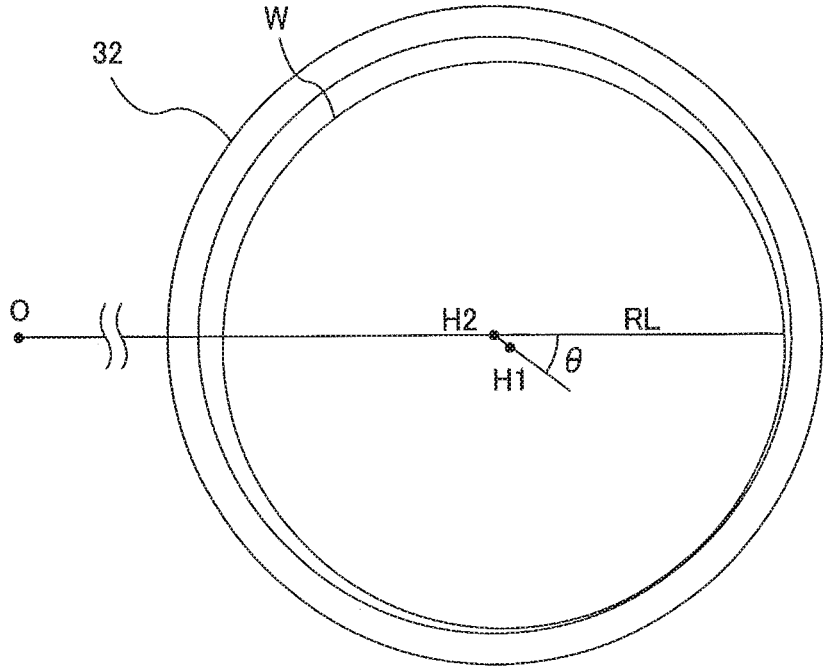
FIG. 10 is a diagram for explaining an angle of eccentricity.

FIG. 10 is a diagram illustrating the angle of eccentricity. The symbol θ shown in FIG. 10 denotes the angle of eccentricity. The angle of eccentricity θ is defined as an angle between a reference line RL passing through the center H2 of the polishing head 1 and a straight line passing through the center H2 of the polishing head 1 and the center H1 of the wafer W. In this embodiment, the reference line RL is defined as a straight line passing through the center O of the polishing table 3 and the center H2 of the polishing head 1. In a simulation for obtaining the above-described correlation data, the angle of eccentricity θ is varied from 0 degrees to 180 degrees in one-degree increment, and the number of wafer detection signals is counted at each of the angles of eccentricity θ.

An exemplary simulation will now be described. The conditions of the simulation are as follows.

Diameter of the wafer W: 300 mm

Inner diameter of the retainer ring 32: 305 mm

Distance between the center O of the polishing table 3 and the center H2 of the polishing head 1: 200 mm Distance between the center O of the polishing table 3 and the wafer detection sensor 8: 70 mm Rotational speed of the polishing table 3: 100 $min^{-1}$ Detection cycle of the wafer detection sensor 8: 0.5 ms (milliseconds)

Angle of eccentricity θ: 0° to 180°

Figure 11:
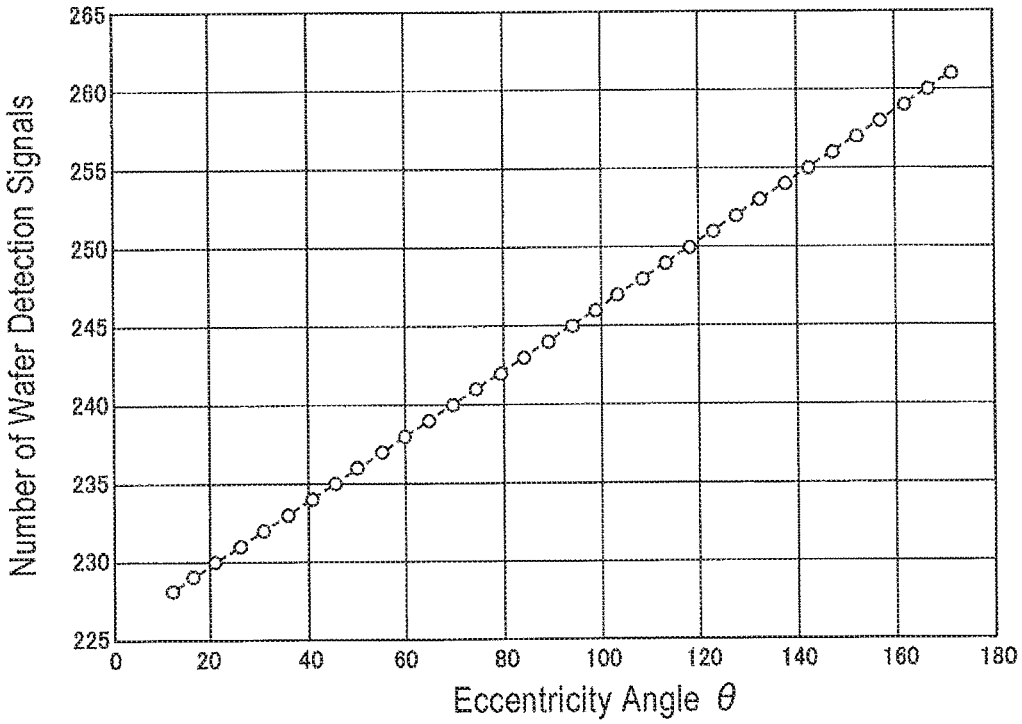
FIG. 11 is a graph showing an example of correlation data obtained by executing a simulation.

FIG. 11 is a graph showing an example of correlation data obtained by performing the simulation. Ordinate axis represents the number of wafer detection signals per rotation of the polishing table 3, and abscissa axis represents the angle of eccentricity θ. In the example shown in FIG. 11, the angle of eccentricity θ increases with an increase in the number of wafer detection signals. Therefore, the data processor 9A counts the number of wafer detection signals during polishing of the wafer W, and can determine a corresponding angle of eccentricity θ based on the correlation data.

Figure 12:
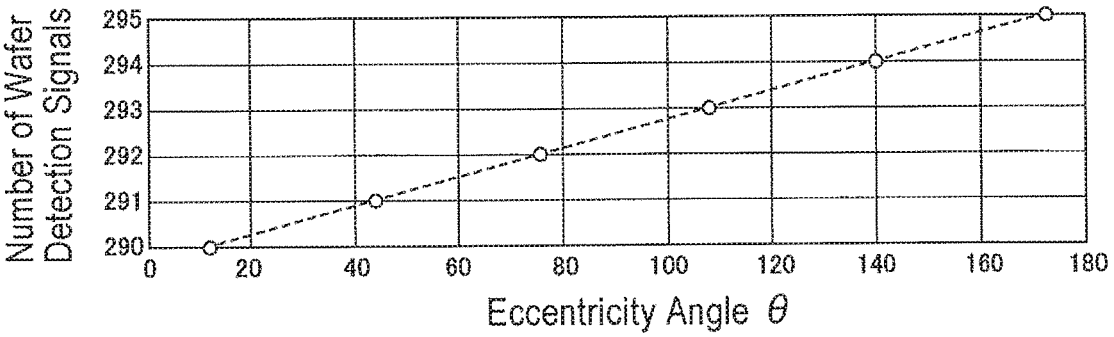
FIG. 12 is a graph showing an example of correlation data obtained by executing a simulation under a condition that a distance between the center of the polishing table and the wafer detection sensor is 200 mm.
Figure 13:
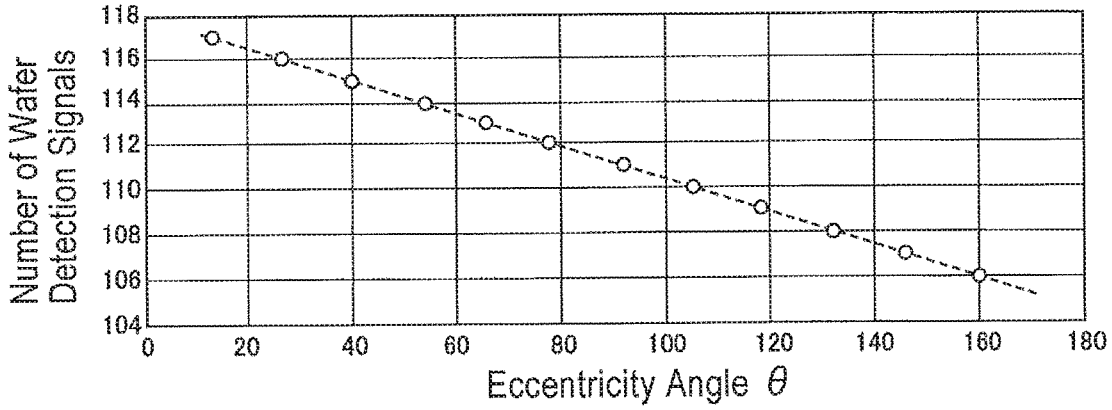
FIG. 13 is a graph showing an example of correlation data obtained by executing a simulation under a condition that a distance between the center of the polishing table and the wafer detection sensor is 330 mm.

FIG. 12 is a graph showing an example of correlation data obtained by performing a simulation under a condition that the distance between the center O of the polishing table 3 and the wafer detection sensor 8 is 200 mm, and FIG. 13 is a graph showing an example of correlation data obtained by performing a simulation under a condition that the distance between the center O of the polishing table 3 and the wafer detection sensor 8 is 330 mm. The other conditions of these simulations are the same as those of the simulation described above with reference to FIG. 11.

The correlation data of FIGS. 12 and 13 show that the number of wafer detection signals does not change greatly with a change in the angle of eccentricity θ. Thus, the use of the correlation data of FIGS. 12 and 13 leads to a low-resolution determination of the angle of eccentricity θ based on a change in the number of wafer detection signals. In contrast, the correlation data of FIG. 11 shows a large change in the number of wafer detection signals. This indicates that the use of the correlation data of FIG. 11 can achieve a high-resolution determination of the angle of eccentricity θ. It will be appreciated from the correlation data shown in FIGS. 11 through 13 that the distance between the center O of the polishing table 3 and the wafer detection sensor 8 is preferably shorter than the distance between the center O of the polishing table 3 and the center H2 of the polishing head 1.

In this manner, the data processor 9A determines, based on the correlation data, the angle of eccentricity θ corresponding to the number of wafer detection signals which indicate that the wafer W is present over the wafer detection sensor 8. The data processor 9A corrects the positions of measurement points of the film-thickness sensor 7 based on the determined angle of eccentricity θ. More specifically, the data processor 9A corrects the positions of measurement points based on the determined angle of eccentricity θ and the distance between the center H1 of the wafer W and the center H2 of the polishing head 1.

The distance between the center H1 of the wafer W and the center H2 of the polishing head 1 can be obtained by dividing the difference between the inner diameter of the retainer ring 32 and the diameter of the wafer W by 2. Since the wafer W keeps in contact with the inner peripheral surface 32*a* of the retainer ring 32 during polishing of the wafer W, the distance between the center H1 of the wafer W and the center H2 of the polishing head 1 is constant regardless of the angle of eccentricity θ.

Figure 14:
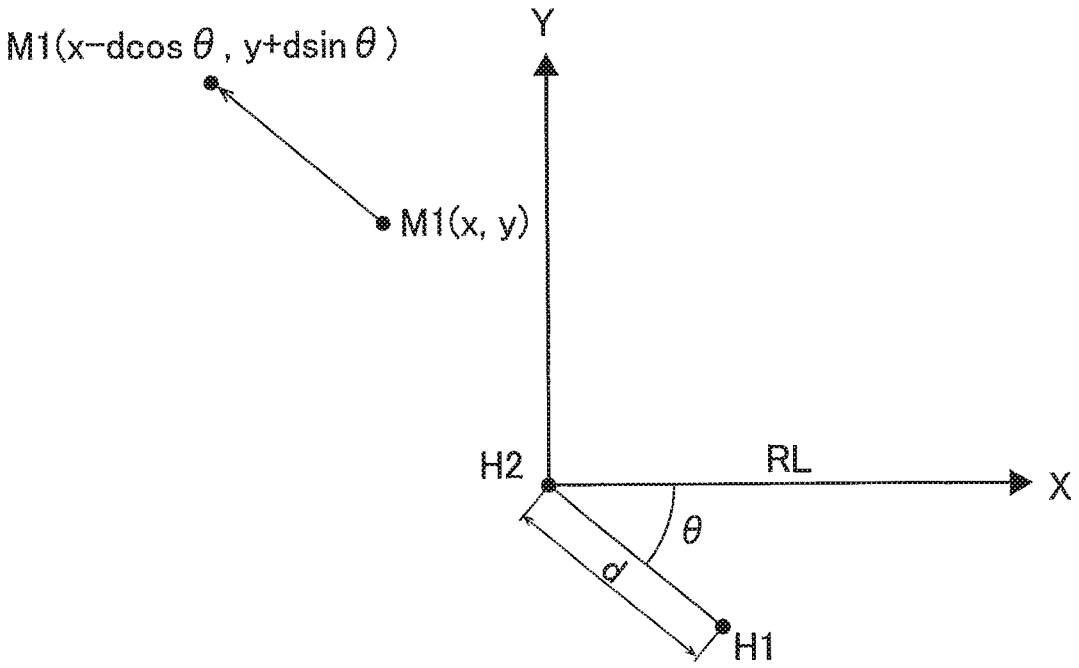
FIG. 14 is a schematic diagram showing an embodiment of correcting a position of a measurement point on a wafer.

FIG. 14 is a schematic diagram illustrating an embodiment of the correction of the positions of measurement points on the wafer W. In order to specify a position of a film-thickness measurement point M1 on the surface of the wafer W, an XY coordinate system is defined on the surface of the wafer W. The XY coordinate system has an origin on the center H2 of the polishing head 1. An X-axis of the XY coordinate system coincides with the reference line RL, and a Y-axis of the XY coordinate system passes through the center H2 of the polishing head 1 and is perpendicular to the reference line RL. Where d represents the distance between the center H1 of the wafer W and the center 112 of the polishing head 1, coordinates of the center H1 of the wafer W are expressed as (d cos θ, −d sin θ). The coordinates are stored in the data processor 9A as a coordinate correction value for correcting the positions of film-thickness measurement points on the surface of the wafer W.

The data processor 9A corrects the position of the measurement point M1 based on the coordinate correction value (d cos θ, −d sin θ). In this embodiment, the data processor 9A corrects the position of the measurement point M1 by subtracting the coordinate correction value (d cos θ, −d sin θ) from coordinates (x, y) of the measurement point M1. The corrected position of the measurement point M1 is expressed as (x−d cos θ, y+d sin θ). This corrected position of the measurement point M1 is the actual position of the measurement point at which a film-thickness signal has been generated. Similarly, a position of other measurement point is corrected by subtracting the coordinate correction value (d cos θ, −d sin θ) from coordinates of that measurement point.

Based on a film-thickness signal generated by the film-thickness sensor 7 and the corrected position (actual position) of a measurement point at which the film-thickness signal has been generated, the data processor 9A determines an optimum polishing pressure at that measurement point, i.e. a target value of the polishing pressure at that measurement point. In one embodiment, based on a film-thickness signal generated by the film-thickness sensor 7 and the corrected position (actual position) of a measurement point at which the film-thickness signal has been generated, the data processor 9A determines a film-thickness value at the corrected position, and determines a target pressure value of the pressure chamber (one of the pressure chambers C1 to C4 shown in FIG. 3) which can minimize a difference between the determined film thickness and a target film thickness at the corrected position. The data processor 9A transmits the determined target pressure value to the operation controller 9B. The target pressure value of the pressure chamber corresponds to a target value of the polishing pressure to be applied from the polishing head 1 to the wafer W. The operation controller 9B receives the target pressure value of the pressure chamber from the data processor 9A and, based on the target pressure value of the pressure chamber, controls the polishing pressure applied from the polishing head 1 to the wafer W. More specifically, the operation controller 9B transmits the target pressure value of the pressure chamber to the corresponding pressure regulator (one of the pressure regulators R1 to R4 shown in FIG. 3), and the pressure regulator maintains the pressure in the pressure chamber at the target pressure value, thereby controlling the polishing pressure applied from the polishing head 1 to the wafer W. According to this embodiment, the optimum polishing pressure can be determined based on a film-thickness signal generated at an actual position of a measurement point. This makes it possible to achieve a target film-thickness profile.

There is no particular limitation on the above-described wafer detection sensor (substrate detection sensor) 8 as long as it can detect the presence of the wafer W. In one embodiment, the wafer detection sensor 8 may be a film-thickness sensor such as an optical film-thickness sensor or an eddy-current sensor. The mechanism of wafer detection by the use of a film-thickness sensor as the wafer detection sensor 8 will now be described with reference to FIG. 15.

Figure 15:
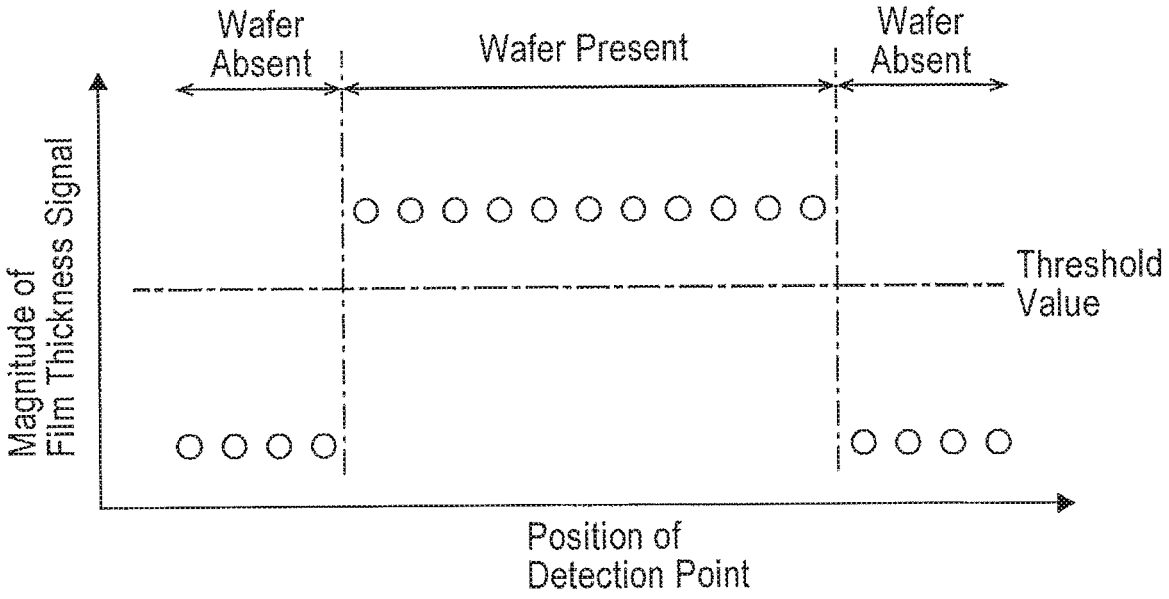
FIG. 15 is a schematic diagram for explaining mechanism by which a wafer detection sensor, comprising a film-thickness sensor, detects a wafer.
Figure 16:
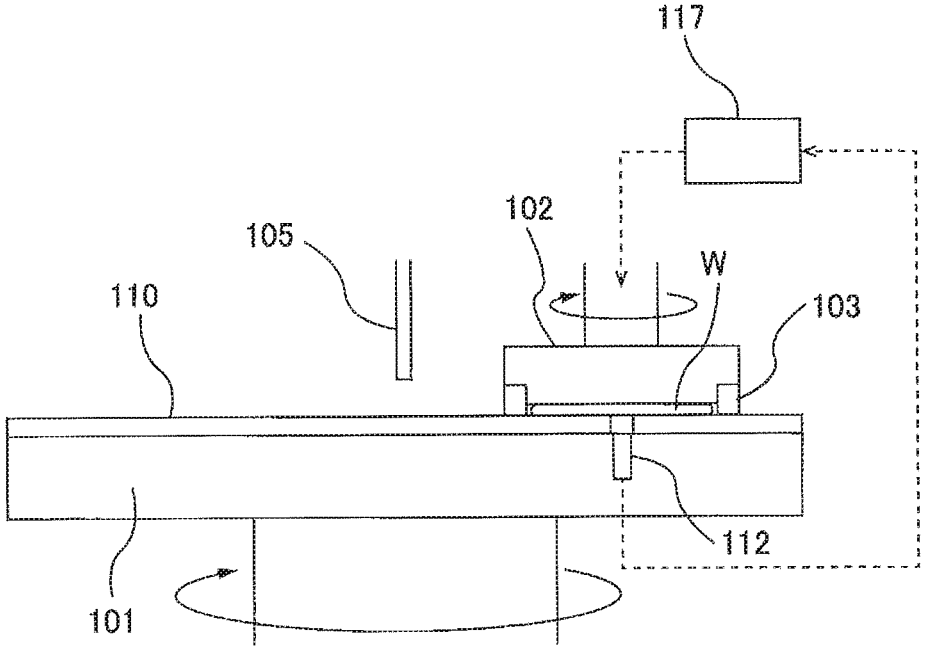
FIG. 16 is a schematic diagram showing a conventional polishing apparatus.
Figure 17:
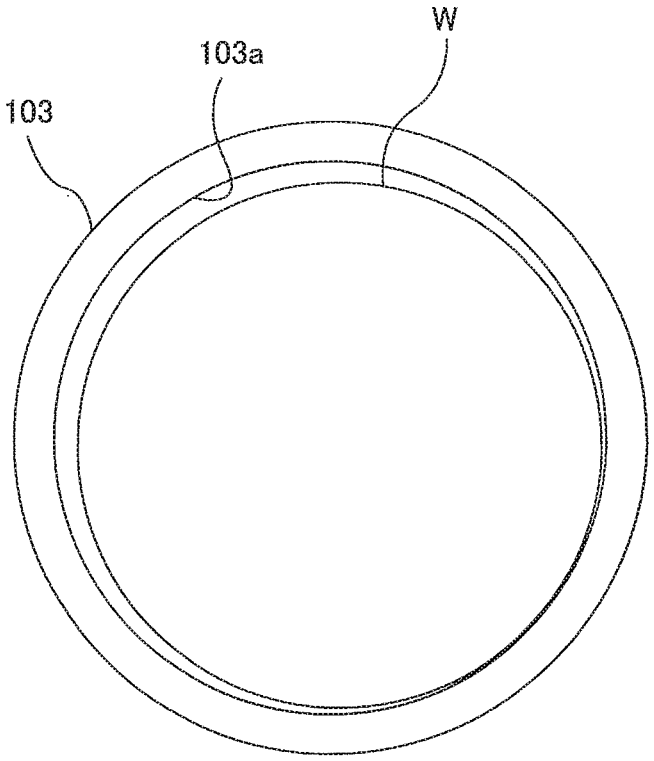
FIG. 17 is a diagram for explaining a difference between a diameter of a wafer and an inner diameter of a retainer ring.

FIG. 15 is a schematic diagram illustrating the mechanism by which the wafer detection sensor 8, comprised of a film-thickness sensor, detects the wafer W. The wafer detection sensor 8 is configured to generate film-thickness signals in a preset cycle (e.g. in a cycle of 0.5 ms). When the wafer W is present over the wafer detection sensor 8, the wafer detection sensor 8 generates film-thickness signals having certain magnitudes due to the presence of the wafer W. On the other hand, when the wafer W is not present over the wafer detection sensor 8, the wafer detection sensor 8 generates film-thickness signals in the preset cycle with very low magnitudes. Thus, film-thickness signals, generated by the wafer detection sensor 8 when the wafer W is present over the wafer detection sensor 8, can be used as wafer detection signals (substrate detection signals). In one embodiment, the wafer detection sensor 8 outputs, as wafer detection signals, film-thickness signals having magnitudes not less than a threshold value. The film-thickness signals as wafer detection signals may be used, together with film-thickness signals generated by the film-thickness sensor 7, for the control of polishing pressure to achieve a target film-thickness profile of the wafer W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing method comprising:

rotating a polishing table in which a substrate detection sensor and a film-thickness sensor are disposed;

pressing a substrate against a polishing pad on the polishing table by a polishing head, including a retainer ring, to polish the substrate;

causing the substrate detection sensor to generate substrate detection signals in a preset cycle and causing the film-thickness sensor to generate a film-thickness signal at a predetermined measurement point during polishing of the substrate while the substrate detection sensor and the film-thickness sensor are moving across a surface of the substrate;

calculating an angle of eccentricity of a center of the substrate relative to a center of the polishing head from the number of substrate detection signals;

correcting a position of the predetermined measurement point based on the angle of eccentricity; and controlling polishing pressure at which the polishing head presses the substrate based on the film-thickness signal and the corrected position of the predetermined measurement point.

2. The polishing method according to claim 1, wherein a distance from a center of the polishing table to the substrate detection sensor is shorter than a distance from the center of the polishing table to the film-thickness sensor.

3. The polishing method according to claim 2, wherein during polishing of the substrate, the substrate detection sensor moves across an edge area of the substrate, and the film-thickness sensor moves across the edge area and an area inside the edge area.

4. The polishing method according to claim 1, wherein correcting the position of the predetermined measurement point based on the angle of eccentricity comprises:

calculating a coordinate correction value from the angle of eccentricity and a numerical value obtained by dividing a difference between a diameter of the substrate and an inner diameter of the retainer ring by 2; and correcting the position of the predetermined measurement point based on the coordinate correction value.

5. The polishing method according to claim 1, wherein the substrate detection sensor is a film-thickness sensor.

6. The polishing method according to claim 5, wherein the substrate detection sensor is an optical film-thickness sensor.

7. The polishing method according to claim 5, wherein the substrate detection sensor is an eddy-current sensor.

8. A polishing apparatus comprising:

a polishing table for supporting a polishing pad;

a polishing head configured to press a substrate against the polishing pad to polish the substrate;

a film-thickness sensor configured to generate a film-thickness signal at a predetermined measurement point, the film-thickness sensor being installed in the polishing table;

a substrate detection sensor configured to generate substrate detection signals in a preset cycle, the substrate detection sensor being installed in the polishing table;

a data processor configured to calculate an angle of eccentricity of a center of the substrate relative to a center of the polishing head from the number of substrate detection signals, correct a position of the predetermined measurement point based on the angle of eccentricity, and determine a target value of polishing pressure at which the polishing head presses the substrate based on the film-thickness signal and the corrected position of the predetermined measurement point; and an operation controller configured to control the polishing pressure at which the polishing head presses the substrate based on the target value of polishing pressure.

9. The polishing apparatus according to claim 8, wherein a distance from a center of the polishing table to the substrate detection sensor is shorter than a distance from the center of the polishing table to the film-thickness sensor.

10. The polishing apparatus according to claim 8, wherein the data processor is configured to:

calculate a coordinate correction value from the angle of eccentricity and a numerical value obtained by dividing a difference between a diameter of the substrate and an inner diameter of the retainer ring by 2; and correct the position of the predetermined measurement point based on the coordinate correction value.

11. The polishing apparatus according to claim 8, wherein the substrate detection sensor is a film-thickness sensor.

12. The polishing apparatus according to claim 11, wherein the substrate detection sensor is an optical film-thickness sensor.

13. The polishing apparatus according to claim 11, wherein the substrate detection sensor is an eddy-current sensor.

* * * * *